US011148267B2

(12) United States Patent
Gruner

(10) Patent No.: US 11,148,267 B2
(45) Date of Patent: Oct. 19, 2021

(54) TENSIONING DEVICE FOR TENSIONING A HELICAL SPRING

(71) Applicant: Andreas Heiko Gruner, Bad Blankenburg (DE)

(72) Inventor: Andreas Heiko Gruner, Bad Blankenburg (DE)

( * ) Notice: Subject to any disclaimer, the term of this patent is extended or adjusted under 35 U.S.C. 154(b) by 198 days.

(21) Appl. No.: 16/477,556

(22) PCT Filed: Jan. 10, 2018

(86) PCT No.: PCT/EP2018/050521
§ 371 (c)(1),
(2) Date: Jul. 12, 2019

(87) PCT Pub. No.: WO2018/130548
PCT Pub. Date: Jul. 19, 2018

(65) Prior Publication Data

US 2019/0358797 A1 Nov. 28, 2019

(30) Foreign Application Priority Data

Jan. 13, 2017 (DE) ..... 10 2017 100 581.1

(51) Int. Cl.
*B25B 27/30* (2006.01)
*E05D 13/00* (2006.01)

(52) U.S. Cl.
CPC ..... *B25B 27/30* (2013.01); *E05D 13/1261* (2013.01); *E05Y 2201/492* (2013.01); *E05Y 2201/718* (2013.01)

(58) Field of Classification Search
CPC . B25B 27/30; E05D 13/00; B66F 3/16; B66F 3/18; B60S 9/18
See application file for complete search history.

(56) References Cited

U.S. PATENT DOCUMENTS 3,651,719 A 3/1972 Wessel
3,921,761 A 11/1975 Votroubek et al.
(Continued)

FOREIGN PATENT DOCUMENTS

DE 4341309 C1 3/1995
DE 202012005626 U1 6/2012
(Continued)

*Primary Examiner* — Lee D Wilson
(74) *Attorney, Agent, or Firm* — Stuart H. Mayer; Mayer & Williams PC

(57) ABSTRACT

The invention relates to a tensioning device (01) for tensioning a coil spring (02) that is supported on a main shaft (03) and at a fixed end is rotatably fixedly connected to a frame. The tensioning device (01) includes a gear drive (05), having a first gear element (06) that is axially displaceably guided on the main shaft (03) and rotatably fixedly connected to a free end of the coil spring (02), and having a second gear element (07) that is in drive engagement with the first gear element (06) in order to set the first gear element (06) in rotation about the main shaft (03). The tensioning device (01) also includes a retaining element (19) that holds the second gear element (11) in the position of drive engagement with the first gear element (06). Furthermore, the tensioning device (01) includes a drive element that is coupled to the second gear element (12) in order to set it in rotation. The gear drive is formed as a bevel gear transmission, wherein the first gear element (06) is formed as a bevel gear (06) and the second gear element (07) is formed as a bevel gear pinion (07), and wherein the rotational axes of the two gear elements (06, 07) extend perpendicularly to one another. The bevel gear (06) is integrally connected to a guide bushing (10), and has a central opening (09) through which the main shaft (03) extends, and has a cylindrical receiving section (12) in which the free end of the coil spring (02) is fastened.

5 Claims, 2 Drawing Sheets

(56) References Cited

U.S. PATENT DOCUMENTS

| | | | | |
|---|---|---|---|---|
| 4,625,946 | A * | 12/1986 | Clark, Jr. | B66D 5/24 254/274 |
| 7,909,305 | B2 | 3/2011 | Helwick | |
| 8,936,063 | B1 | 1/2015 | Trujillo et al. | |
| 2015/0177098 | A1* | 6/2015 | Brandstrom | G01M 13/021 702/41 |
| 2016/0023641 | A1* | 1/2016 | Klassy | B60S 9/08 280/766.1 |
| 2018/0008158 | A1 | 1/2018 | Pekander et al. | |
| 2019/0358797 | A1* | 11/2019 | Gruner | B25B 27/30 |

FOREIGN PATENT DOCUMENTS

| | | | |
|---|---|---|---|
| DE | 102012104673 | B3 | 8/2013 |
| DE | 102013101083 | A1 | 8/2014 |
| DE | 202011050354 | U1 | 8/2014 |
| DE | 102014013449 | A1 | 3/2016 |

* cited by examiner

TENSIONING DEVICE FOR TENSIONING A HELICAL SPRING

BACKGROUND OF THE INVENTION

The present invention relates to a tensioning device for tensioning a coil spring that acts as a torsion spring, wherein the spring is tensioned by twisting its two ends toward one another, so that the spring in a tensioned state has a different axial length than in its relaxed state.

Tensioned coil springs of this type are used, for example, for drive assistance of sectional doors. Sectional doors are made up of multiple door sections which are foldably connected to one another and which on the end-face side each have one or more track rollers guided in slide rails. A drive shaft that is connected to a drive, usually an electric motor, is used to raise and lower the sectional door. Coil springs are mounted on the drive shaft. The elastic force of the coil springs acts against the intrinsic weight of the door in order to assist the rotation of the drive shaft and relieve load on the electric drive. The coil spring is fixedly mounted on the drive shaft. During installation, the coil spring is tensioned by introducing a torque at the end of the coil spring that is not rotatably fixedly mounted, so that the spring may be tensioned, and the spring in the tensioned state is fastened to the drive shaft. An auxiliary device for tensioning the spring is necessary due to the required large forces and torques.

Various devices for tensioning springs are known from the prior art.

A suspension strut tensioner for replacing a spring or a shock absorber of a suspension strut of a motor vehicle is described in DE 10 2014 013 449 A1. The spring tension is achieved by two horseshoe-shaped spring holders of the suspension strut tensioner, situated eccentrically with respect to the spring, which engage with the interior of the coil spring and move toward one another by actuating a spindle situated on the suspension strut tensioner. The axial offset of each wire circumference at both of its ends is thus reduced, resulting in tensioning of the spring.

DE 10 2013 101 083 A1 relates to an auxiliary tool for installing a shock absorber, including a holding assembly and a drive assembly. The auxiliary tool has a thread advance and is situated coaxially with respect to the spring to be tensioned. The auxiliary tool is manually rotated about the rotational axis by use of a rotary element. The spring is tensioned or relaxed by changing the axial offset of the wire circumference.

DE 20 2012 005 626 U1 describes a pressure plate for a spring tensioner for tensioning a coil spring of a spring damper strut that is accommodated between a lower and an upper spring plate. The pressure plate is mounted on the upper spring plate for axially supporting retaining elements, and the retaining elements may be brought into engagement with the spring windings of the coil springs.

DE 20 2011 050 354 U1 relates to a clamping plate for a spring tensioner, and a spring tensioner for installing and removing coil compression springs, in particular on spring-mounted suspension systems. The clamping plate has a contact surface for holding a spring segment, via which a compression force may be applied to the suspension spring in the axial direction.

U.S. Pat. No. 7,909,305 B2 describes a suspension strut removal device, comprising two compressor plates that are designed in such a way that they have a fastening area with which they are connected to a driving threaded section. In addition, each compressor plate has a device that is designed for engagement with a respective first coil of a coil spring. The device is drivable with a manually produced torque.

The tensioning devices described above generate a force that acts axially on the spring, without a torque acting on the spring to be tensioned.

DE 10 2012 104 673 B3 relates to a tool, a system, and a method for screwing together coil compression springs, generally two, to form a single coil disk spring. Handles for operating the tool are formed on the tool that is used for this purpose.

U.S. Pat. No. 3,651,719 teaches a torsion spring adjustment tool for overhead doors, with which the tension of torsion springs may be varied. The tool has a split clamping device, and may be brought into engagement with the adjustable sleeve anchor. Circumferentially spaced rounded teeth are provided for this purpose. Handle sections for manual operation are provided on the tool in order to introduce torque into the tool.

A disadvantage of the approaches according to DE 10 2012 104 673 B3 and U.S. Pat. No. 3,651,719 is that the devices must be operated by hand. For springs that are designed for use as a door counterweight in sectional doors, in the known devices a large amount of muscular power is required for tensioning the coil spring. In addition, due to the confined installation situation, the tool must be continually reapplied during the tensioning. Furthermore, as a result of the installation position the operator must assume an ergonomically unfavorable posture during the tensioning. This operation results in a not inconsiderable risk to the operator until the torsion spring can be secured in a tensioned end position. In some cases, two persons must simultaneously carry out the torsion spring installation.

U.S. Pat. No. 3,921,761 A describes a method and a device for winding torsion springs. The device comprises a torsion spring which with a first end is fixed to a support means. A second end of the torsion spring is twistable with respect to the first end. The device further comprises a gear means and a rotatable worm gear, the gear means having least one gear member that is rotatable by means of the worm gear. The worm gear is connected via a support plate to a stationary component that is movable relative to the gear member and holds the worm gear in position. The device further comprises a drive element in the form of a cordless screwdriver or an electric motor.

Proceeding from the prior art, the object of the present invention is to design the tensioning of coil springs so that less muscular power is required, and with less risk. A further aim is to prevent possible damage, for example to the door, during tensioning of the spring.

SUMMARY OF THE INVENTION

This object is achieved by a tensioning device according to the invention for tensioning a coil spring according to appended claim 1.

The tensioning device according to the invention is used for tensioning a coil spring that is supported on a main shaft. At one end the coil spring is fixedly connected to a frame part or housing part in which a bearing block is situated. The tensioning device includes a gear drive. The gear drive includes a first gear element and a second gear element. The first gear element is axially displaceably guided on the main shaft and rotatably fixedly connected to a free end of the coil spring. The second gear element is in drive engagement with the first gear element; i.e., the second gear element drives the first gear element and sets it in rotation about the main shaft. Due to the rotatably fixed connection of the coil spring at its fixed end to the frame, the coil spring is tensioned or relaxed when a torque is introduced via the end that is connected to the first gear element.

The tensioning device also includes a retaining element. The retaining element holds the second gear element in the position of drive engagement with the first gear element during the tensioning operation.

The tensioning device also includes a drive element. The drive element is preferably detachably coupled to the second gear element in order to set it in rotation for the tensioning operation.

The advantages of the invention are seen in particular in that for tensioning, the tensioning device is operable by one person and less force must be applied by the person. As a result, safety during pretensioning of large coil springs is increased, and the coil springs may be installed with the required pretensioning in a more favorable, rapid, and simple manner.

The gear drive of the tensioning device according to the invention is designed as a bevel gear transmission. Thus, the first gear element is formed as a bevel gear and the second gear element is formed as a bevel gear pinion. The rotational axis of the first gear element and of the second gear element hereby extend perpendicularly to one another. The rotational axis of the main shaft is preferably situated coaxially with respect to the rotational axis of the first gear element. A guide pin for axially central support of the bevel gear pinion is situated perpendicular thereto. The bevel gear has a central opening that is used for guiding the main shaft through. A central opening in the bevel gear pinion is used to accommodate a guide pin, and may be formed by a through opening. A drive shaft whose one end is designed as a guide pin may thus be situated in the axial through opening in the bevel gear pinion.

The bevel gear is connected to a guide bushing. The guide bushing is axially displaceably guided on the main shaft, so that the guide bushing together with the bevel gear is axially displaceable on the main shaft. On its outer circumference the guide bushing has a guide groove. The guide pin of the bevel gear pinion is supported in the guide groove.

The bevel gear is integrally connected to the guide bushing. The bevel gear has a cylindrical receiving section on its side facing axially away from the guide bushing. The free end of the coil spring is rotatably fixedly fastened to this receiving section. The coil spring is fastened to the receiving section by welding or riveting, for example. In another embodiment, the coil spring may be detachably fastened to the receiving section, for example by screwing it down. The rotatably fixed connection of the coil spring to the receiving section transmits a torque, acting on the bevel gear, to the coil spring. The applied torque tensions or relaxes the coil spring, depending on the rotational direction and the starting position of the coil spring. As a result of the change in the axial extension of the spring that hereby occurs, the position of the free end of the coil spring along the main shaft is moved between a tensioned end position and a relaxed end position. The bevel gear, which is connected to the coil spring, thus also moves on the main shaft between these two end positions. Since the bevel gear is in drive engagement with the bevel gear pinion for tensioning or relaxing the coil spring, it is necessary that the bevel gear pinion engages well with the bevel gear and is entrained in its movement. The tensioning device has the retaining element for this purpose.

The retaining element preferably includes a bracket and a pressure plate that is connected to the bracket. The bracket is mountable so that it engages around the guide bushing and the bevel gear pinion. The pressure plate is preferably positioned to apply a retaining force in the axial direction on a side facing away from the guide bushing and on a base surface of the bevel gear pinion perpendicular to the rotational axis thereof. The guide pin on which the bevel gear pinion is supported is thereby pressed into the guide groove in the guide bushing of the bevel gear. The bevel gear thus remains in engagement with the bevel gear pinion during tensioning or relaxing of the coil spring.

Furthermore, a first counterpiece is advantageously situated between the bracket and the guide bushing. A second counterpiece may be placed between the pressure plate and the base surface of the bevel gear pinion. The counterpieces assist with uniform introduction of the retaining force by the retaining element, in that due to sufficiently large contact surfaces they form sufficiently large contact areas between the retaining element and the gear elements. For this purpose, the counterpieces preferably have a shape that is adapted to the geometry of the retaining element and the geometry of the gear elements, and are made of materials that are durable under the forces that act.

In one preferred embodiment, the drive element is formed as an electric motor. The second gear element, i.e., the bevel gear pinion, is mounted on an axle of the electric motor. It is particularly preferred and also advantageous for the end of the motor axle on which the second gear element is situated to be designed as a guide pin for supporting the bevel gear pinion. In the simplest case, a hand drill or a cordless screwdriver may be considered as the drive element.

One preferred design of the tensioning device is characterized in that it also has fixing elements. The first gear member is nonrotatably fixable to the main shaft by means of the fixing elements. A fixing element may be, for example, a wedge, a pin, a screw, a bolt, or the like. For the fixing, for example a groove is provided in the main shaft and at least one through opening corresponding thereto is provided in the first gear member. Each of the through openings preferably extends radially circumferentially along the outer circumference in sections, in the area of the guide bushing of the bevel gear, in the cylindrical receiving section of the bevel gear, or on the bevel gear itself. The through openings are formed by boreholes or elongated holes, for example, and are used for passing a fixing element through.

According to one advantageous embodiment, the second gear element is detachably mounted on the first gear element so that the drive engagement may be discontinued. To release the second gear element, the bracket and the pressure plate, i.e., the retaining element, are preferably detachably mounted on the tensioning device. Due to releasing the retaining element, there is no retaining force applied to the base surface of the bevel gear pinion. The guide pin of the second gear element is thus released from the guide groove of the first gear element, so that the second gear element is removable. The bracket is detachably connected to the pressure plate by screws, for example.

BRIEF DESCRIPTION OF THE DRAWINGS

Further advantages, particulars, and refinements of the invention result from the following description of one preferred embodiment, with reference to the drawings, which show the following.

DETAILED DESCRIPTION OF THE INVENTION

Figure 1:
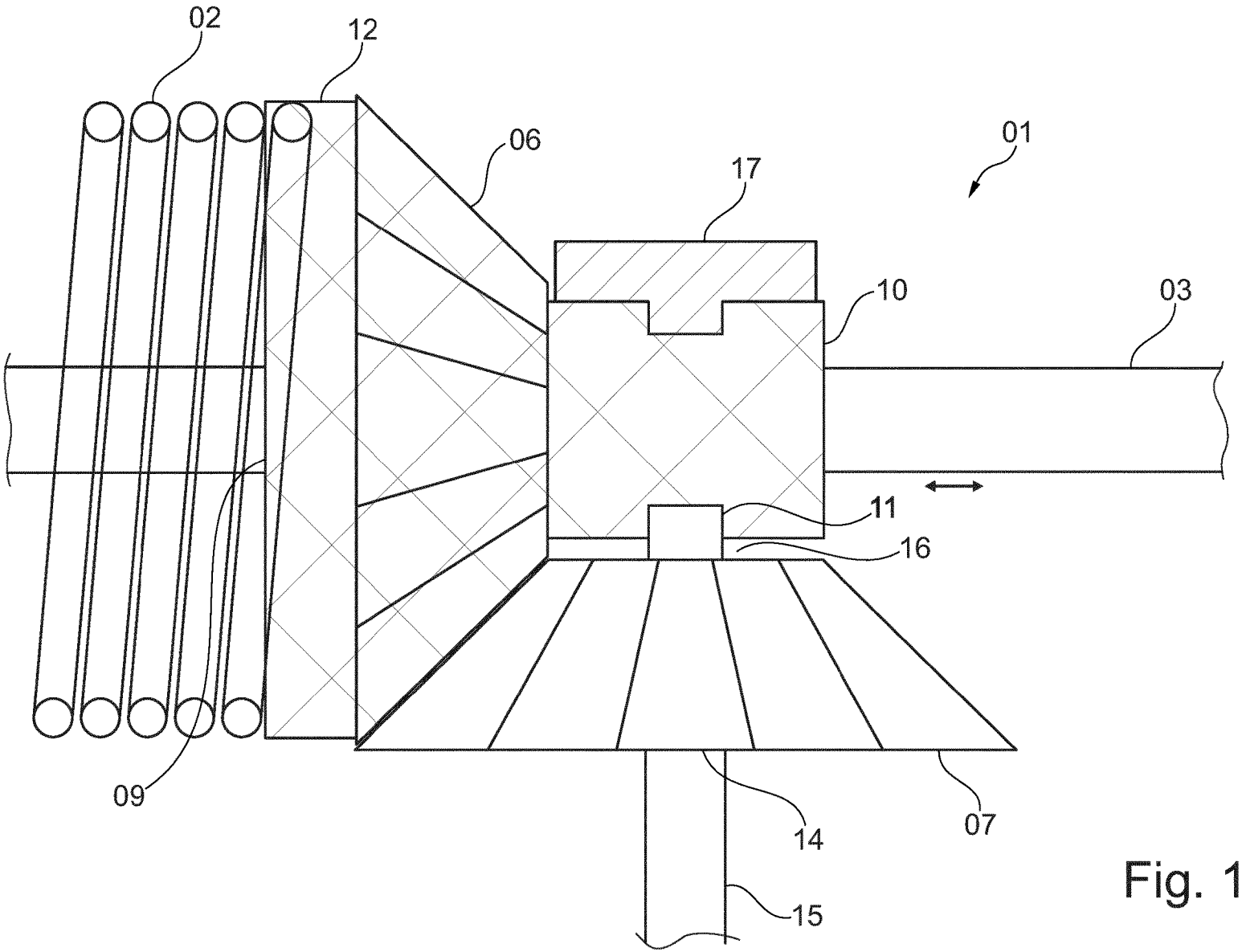
FIG. 1 shows a side view of a tensioning device according to the invention for tensioning a coil spring.

FIG. 1 shows a side view of a tensioning device 01 according to the invention for tensioning a coil spring 02 that is guided on a main shaft 03. The area in which the coil spring 02 at a fixed end is rotatably fixedly connected to a housing part or a frame (not shown) is not illustrated.

The tensioning device includes a gear drive that is formed by a first gear element 06 and a second gear element 07, the first gear element 06 being designed as a bevel gear and the second gear element 07 being designed as a bevel gear pinion. The rotational axis of the bevel gear 06 extends perpendicularly with respect to the rotational axis of the bevel gear pinion 07.

The bevel gear 06 is axially displaceably guided on the main shaft 03. For this purpose, the bevel gear 06 has a first axial through opening 09 through which the main shaft 03 extends.

The bevel gear 06 on its side facing away from the coil spring 02 is connected to a guide bushing 10. The guide bushing 10 is preferably integrally formed on the bevel gear and has a guide groove 11. The guide groove 11 has a radially circumferential design. The side of the bevel gear 06 directed toward the coil spring has a cylindrical receiving section 12. The through opening 09 continues in the guide bushing 10 and in the receiving section 12.

One end of the coil spring 02 that is rotatable with respect to the main shaft 03 during the tensioning operation is fastened to the receiving section 12, so that a torque is transmitted into the coil spring 02 when the first gear element 06 rotates. The applied torque results in tensioning or relaxing of the coil spring, depending on the rotational direction of the first gear element 06.

The bevel gear pinion 07 has a second axial through opening 14. The second through opening 14 is used to accommodate a drive shaft 15 that is designed to be connectable at one end to an electric drive (not illustrated), and whose free end is designed as a guide pin 16. The drive shaft 15 is rotatably fixedly connected to the bevel gear pinion 07, and transmits a torque from the electric drive to the bevel gear pinion 07. For guiding the bevel gear pinion 07, the guide pin 16 of the bevel gear pinion 07 is situated in the guide groove 11, in engagement with the bevel gear 06. Alternatively, the bevel gear pinion, the drive shaft, and the guide pin may have an integral design.

FIG. 1 also shows a first counterpiece 17 that is situated on the guide bushing 10 and has an inwardly directed section that engages with the guide groove 11. The contact surfaces of the counterpiece 17 are large enough to form sufficiently large contact areas between a retaining element 19 (FIG. 2) and the guide bushing 10.

Figure 2:
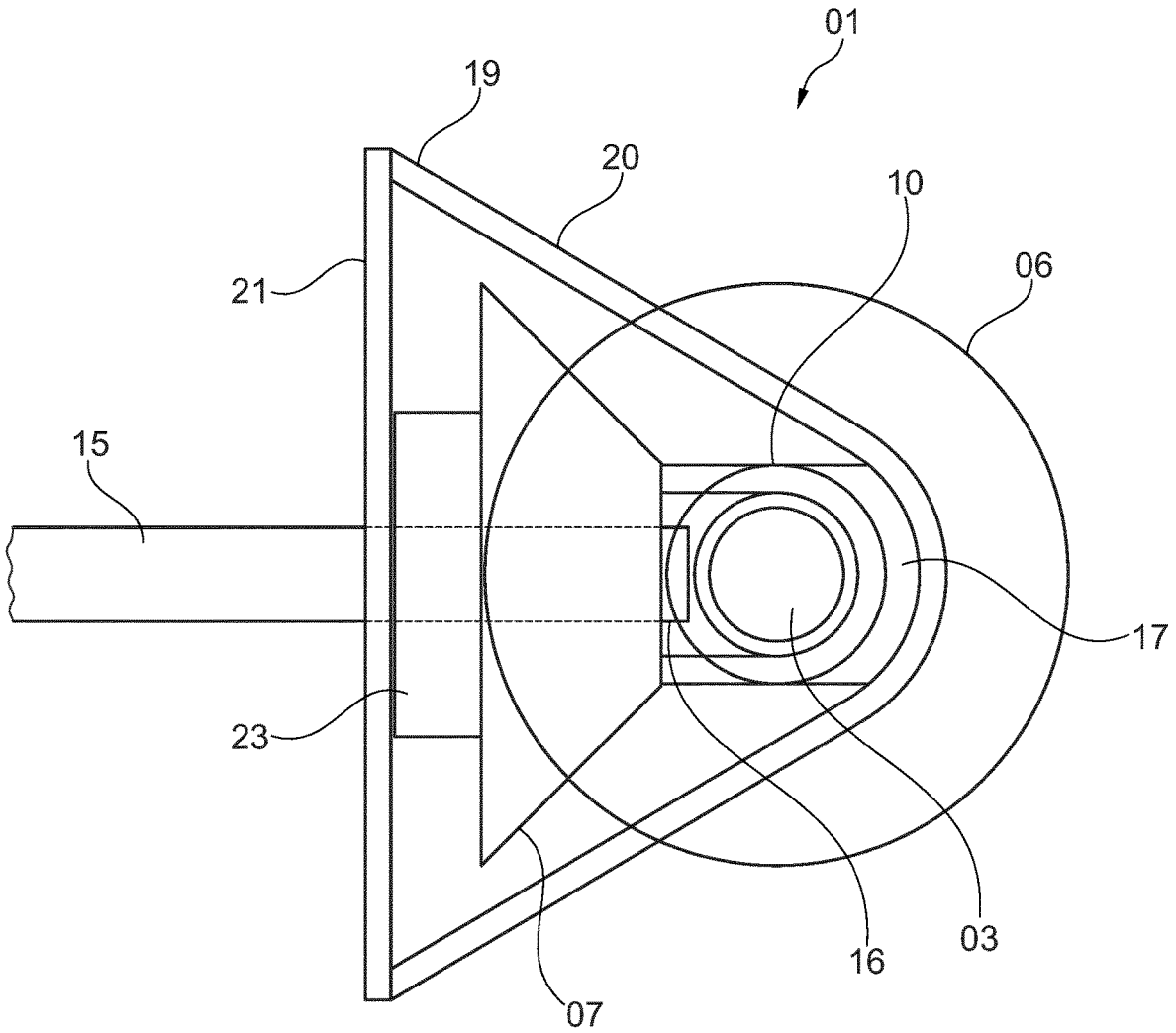
FIG. 2 shows a front view of the tensioning device together with a retaining element.

FIG. 2 shows a front view of the tensioning device 01 together with the retaining element 19. The retaining element 19 includes a bracket 20 and a pressure plate 21. The bracket 20 engages around the guide bushing 10 and the bevel gear pinion 07. The pressure plate 21 is situated on the base surface of the bevel gear pinion 07. The bracket 20 and the pressure plate 21 are preferably detachably mounted in order to release the bevel gear pinion 07. As a result of the retaining element 19, the bevel gear 06 remains in drive engagement with the bevel gear pinion 07, in particular when the position of the bevel gear 06 along the main shaft 03 changes between a tensioned and a relaxed position.

The drive engagement between the bevel gear 06 and the bevel gear pinion 07 may be discontinued as soon as the retaining element 19 is detached and thus, no retaining force acts on the bevel gear pinion 07 and the guide bushing 10 of the bevel gear 06. The detachable connection may be formed by screws, for example.

FIG. 2 also shows the drive axle 15 that extends through the second through opening 14 in the bevel gear pinion 07 and is guided in the guide groove 11. The drive shaft 15 is designed as a guide pin 16 at the end of the drive shaft 15 that is situated in the guide groove 11.

Furthermore, FIG. 2 shows that a second counterpiece 23 is provided in addition to the first counterpiece 17. The two counterpieces 17, 23 are axially spaced apart with respect to the drive axle 15 and oppositely situated, the second counterpiece 23 being situated between the base surface of the bevel gear pinion 07 and the pressure plate 21 of the retaining element 19. The contact surfaces of the second counterpiece 23 are large enough to form sufficiently large contact areas between the retaining element 19, in particular the pressure plate 21, and the base surface of the bevel gear pinion 07.

The invention claimed is:

1. A tensioning device for tensioning a coil spring that is supported on a main shaft and at a fixed end is rotatably fixedly connected to a frame or housing part, the tensioning device comprising:

a gear drive having a first gear element that is axially displaceably guided on the main shaft and rotatably fixedly connected to a free end of the coil spring, and having a second gear element that is in drive engagement with the first gear element in order to set the first gear element in rotation about the main shaft;

a retaining element that holds the second gear element in the position of drive engagement with the first gear element;

a drive element that is coupled to the second gear element in order to set the second gear element in rotation; wherein the gear drive is formed as a bevel gear transmission, wherein the first gear element is formed as a bevel gear and the second gear element is formed as a bevel gear pinion, and wherein the rotational axes of the two gear elements extend perpendicularly to one another;

the bevel gear is integrally connected to a guide bushing that is axially displaceably guided on the main shaft, and on an outer circumference of the guide bushing is a guide groove in which an axially central guide pin of the bevel gear pinion is supported, wherein the guide pin is rotatably fixedly connected to the bevel gear pinion;

the bevel gear has a central opening through which the main shaft extends, and has a cylindrical receiving section on the side facing axially away from the guide bushing, in which the free end of the coil spring is fastened;

the retaining element includes a bracket and a pressure plate connected thereto, wherein the bracket engages around the guide bushing and the bevel gear pinion, and wherein the pressure plate is positioned to apply a retaining force to the base surface of the bevel gear pinion in the axial direction, so that the guide pin is pressed into the guide groove.

2. The tensioning device according to claim 1, wherein the drive element is formed by an electric motor, on the motor axis of which the second gear element is mounted.

3. The tensioning device according to claim 1, wherein it also includes a fixing element with which the first gear element may be nonrotatably fixed to the main shaft.

4. The tensioning device according to claim 1, wherein the second gear element is detachably mounted so that the drive engagement may be discontinued.

5. The tensioning device according to claim 4, wherein the bracket and the pressure plate are detachably mounted in order to release the second gear element.

* * * * *